US005527141A

United States Patent [19]

Malmstrom

[11] Patent Number: 5,527,141

[45] Date of Patent: Jun. 18, 1996

[54] COIL INSERTION GUIDE

[75] Inventor: Wayne Malmstrom, Boise, Id.

[73] Assignee: Performance Design, Inc., Boise, Id.

[21] Appl. No.: 291,401

[22] Filed: Aug. 16, 1994

[51] Int. Cl.[6] ..... B42B 5/08

[52] U.S. Cl. ..... 412/38

[58] Field of Search ..... 412/39, 40, 42, 412/33, 9, 38

[56] References Cited

U.S. PATENT DOCUMENTS

| | | | |
|---|---|---|---|
| 3,889,309 | 6/1975 | Adams et al. | 412/39 |
| 4,758,125 | 7/1988 | Wahl | 412/39 |
| 4,874,279 | 10/1989 | Pfaffle | 412/39 |

*Primary Examiner*—Willmon Fridie, Jr.
*Attorney, Agent, or Firm*—Ken J. Pedersen; Barbara S. Pedersen

[57] ABSTRACT

Embodiments of a coil insertion guide, for use with a coil inserter machine, are shown and described. Each embodiment has a plate member with a guide surface for contacting the outer surface of a coil to urge or guide the coil end into the holes of paper or other material being spiral-bound. The guide surface acts as a barrier or limiting wall to hold the coil in an even and consistent path and may also slightly deflect the coil end as it rotates, so that the coil end consistently enters the holes punched in a stack of papers without hanging-up and sticking on the paper around the holes. The preferred embodiment includes a transparent plate, which is pivotally connected to a front table on the machine, and which swings over the paper edge or spine, and over the coil, in order to rest at an angle on the coil. Resting the plate on the coil and designing the plate to have an appropriate weight results in the coil end rotating in a proper path to spiral smoothly through the holes.

10 Claims, 3 Drawing Sheets

COIL INSERTION GUIDE

BACKGROUND OF THE INVENTION

1. Field of the Invention

This invention relates generally to machines for inserting coils into the holes of papers to create spiral-bound books. More specifically, the invention relates to guides for controlling the movement of the coil as it is rotated into the paper holes.

2. Related Art

In the field of book and notebook binding, machines have been designed for semi-automatic insertion of coils into holes punched along the spine, or edge, of paper, cardboard, or other materials. Typically, a pre-fabricated plastic or metal coil is held with its longitudinal centerline parallel to, and at one end of, the line of holes along the spine of the papers that are to be bound. The machine then rotates the coil around its longitudinal centerline so that the end of the coil is inserted into each consecutive hole, "spiraling" through the holes from one end of the notebook to the other. When the coil end reaches the far end of the notebook, the operator stops the machine, cuts the coil, removes the bound notebook, places a new stack of punched paper on the machine with the holes aligned, starts the coil into the first hole, and restarts the machine.

Several companies produce coil inserter machines that work along these general principles. They are typically desk-size machines for use in photocopy, print, and desk-top publishing shops, and in other businesses that produce instruction or repair manuals, notebooks, pamphlets, and catalogs, for example. The CI3000 Coil Inserter or PC2000 Coil Inserter are two such machines, which are produced by Performance Design Inc., of Boise, Id., 83705.

These coil inserters are typically "semi-automatic" in that the machine rotates the coil to spiral through, theoretically, all of the holes along the book spine. However, all of the coil inserters on the market today require significant operator-interaction and effort. This operator-interaction results from the coil end frequently hitting and binding-up on the paper near the holes, thus stopping the coil's progress through the holes and, in effect, stopping the binding process. When this happens, the machine continues to rotate the coil, thus "winding up" the coil while the coil end is stuck in place. To alleviate this situation, the machine operator must give constant attention to the machine, standing at the front of the machine, continuously watching the binding process and keeping at least one hand on the machine. The operator must frequently dislodge the coil end from its stuck position and nudge the coil end down into the hole so that it continues to spiral through the holes. This process of unsticking the coil end prevents the operator from moving his/her eyes or hands away from the machine while it is running and makes the binding task slower and somewhat tedious.

Solutions to this problem have been to change the size or shape of the holes in the paper or material to be bound. Punching larger holes in the paper, relative to the size of the coil, can help alleviate the problem but tends to make a looser and more tear-prone notebook. Punching oval or elongated holes helps alleviate the problem, but the dies for punching such shapes cost on the order of three times as much as those for punching round holes.

What is needed is a system to make spiral-binding with a coil inserter machine more efficient and less demanding for the operator. What is needed is an inexpensive system for keeping the coil end from binding on the paper and keeping it moving smoothly and continuously through the holes of the notebook paper. What is also needed is such a system that can be applied or retro-fit onto a variety of designs of coil inserter machine.

SUMMARY OF THE INVENTION

My invention comprises a system for improving the insertion of the coil into the paper holes when using a coil inserter machine. My coil insertion guide comprises a plate member that has a guide surface that contacts the coil when the coil is spiraling through the holes, and that presses on the coil near the coil end so that the coil end enters the paper holes more readily and consistently. The guide surface preferably extends over the entire width of the hole-punched paper spine and contacts the coil near the coil end as it spirals underneath the plate from one end to the other.

The guide surface serves, I believe, as a limiting surface or barrier to control and stabilize the location of the rotating coil, keeping the coil end rotating in a path with generally a constant radius and position relative to the paper holes. The coil end rotates against the guide surface of the plate, and, I believe, is deflected by the guide surface slightly inward toward the center of the coil, relative to its normal rotational path, as it continues to rotate toward and into the paper hole. The plate urges the coil end to consistently enter the holes without hanging-up, to make the binding task quicker, smoother, easier, and less demanding on operator attention and skill.

In the preferred embodiment, the coil insertion guide includes a connection means, for pivotally connecting the plate to the coil inserter machine, so that the plate may be swung over the coil and book spine and then swung out of the way. In the preferred embodiment, the pressure of the guide surface on the coil is provided by the weight of the plate member resting on the coil. The guide surface preferably rests on the coil at an angle above horizontal, so that the coil contacts the plate when the coil is not quite at the top of its rotation.

DETAILED DESCRIPTION OF THE PREFERRED EMBODIMENTS

Figure 1:
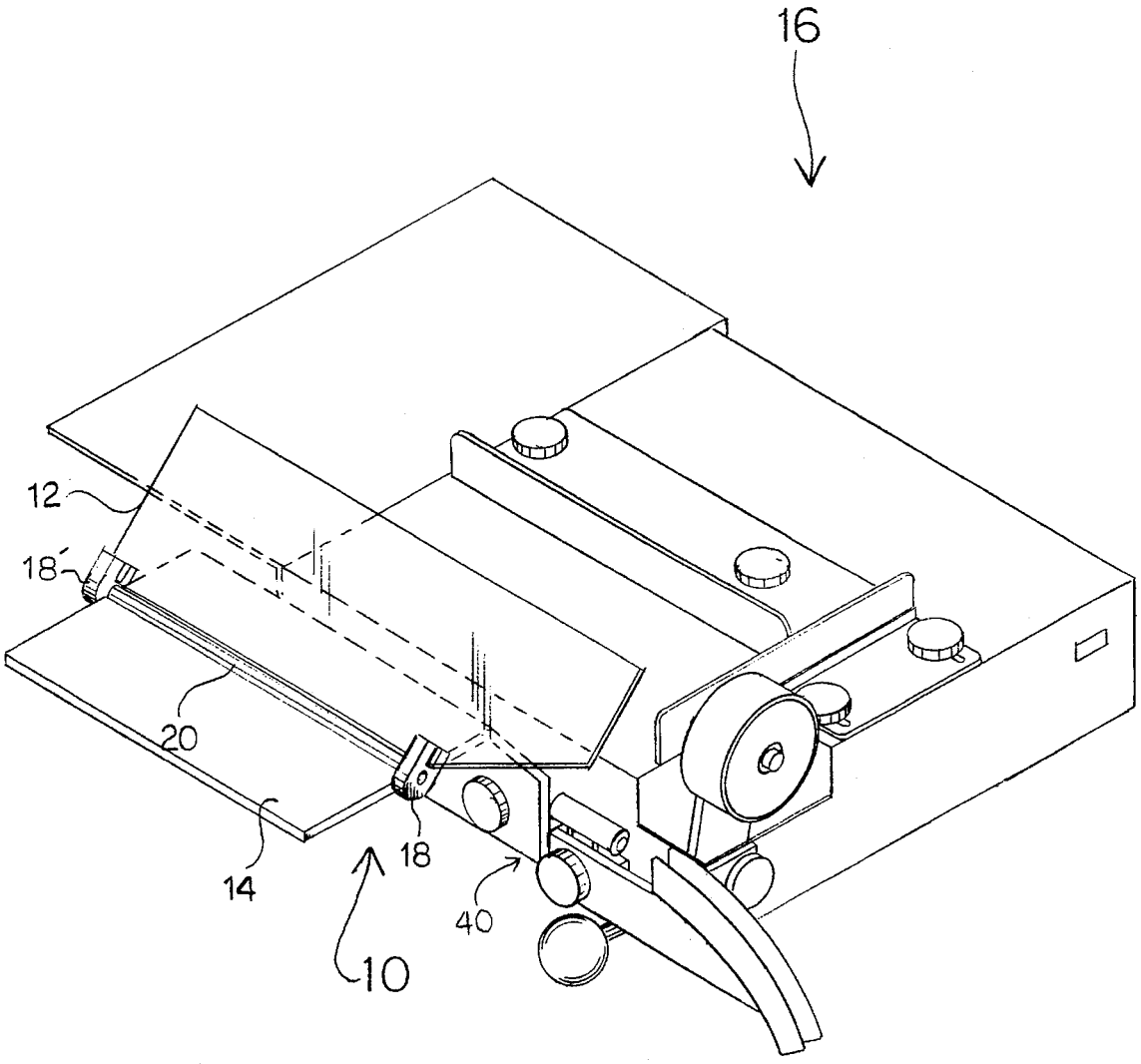
FIG. 1 is a perspective view of one embodiment of the invented coil insertion guide, attached to a coil inserter machine.
Figure 2:
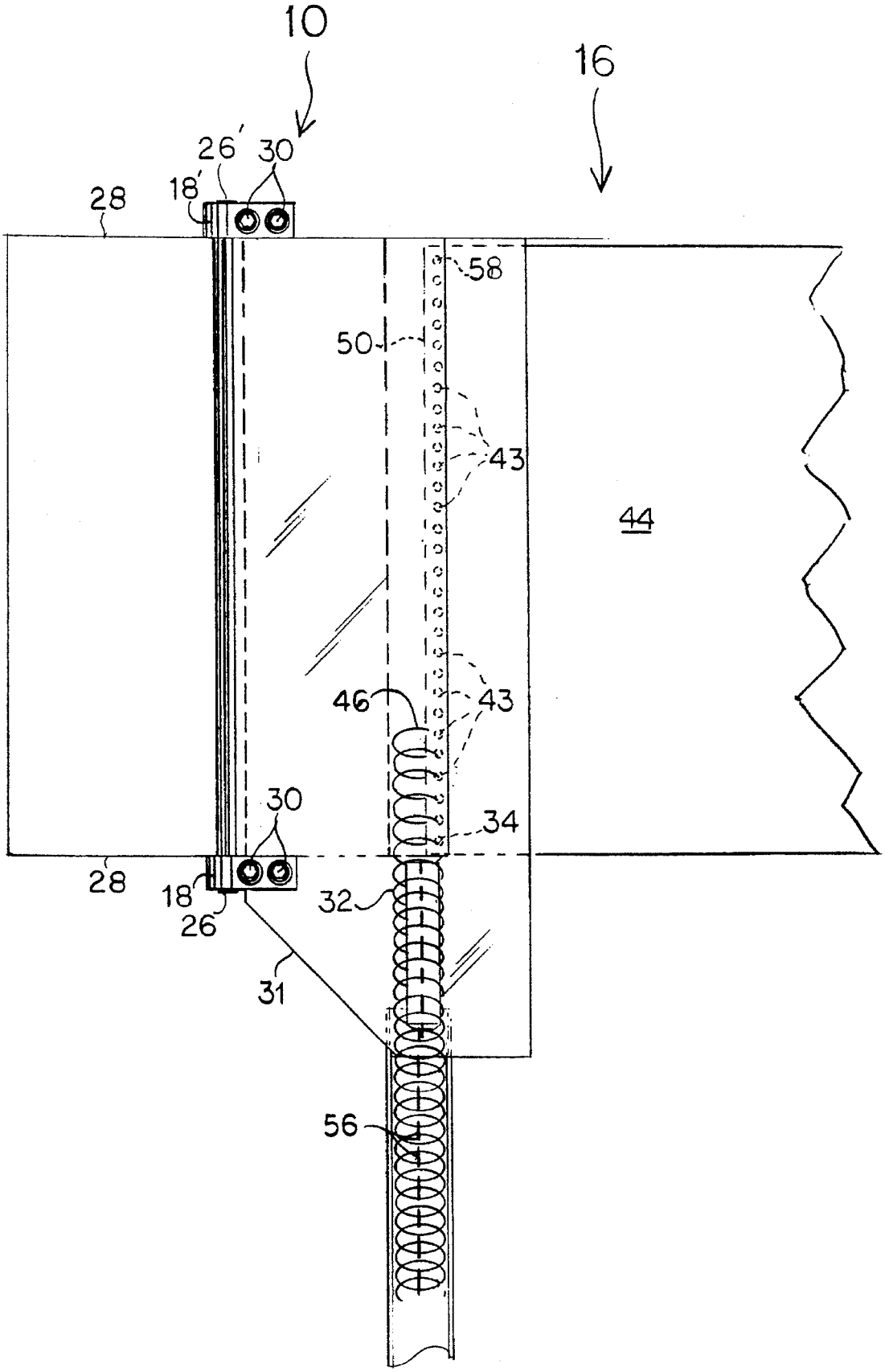
FIG. 2 is a top view of the embodiment of FIG. 1, shown with the coil being rotated into the notebook holes.
Figure 3:
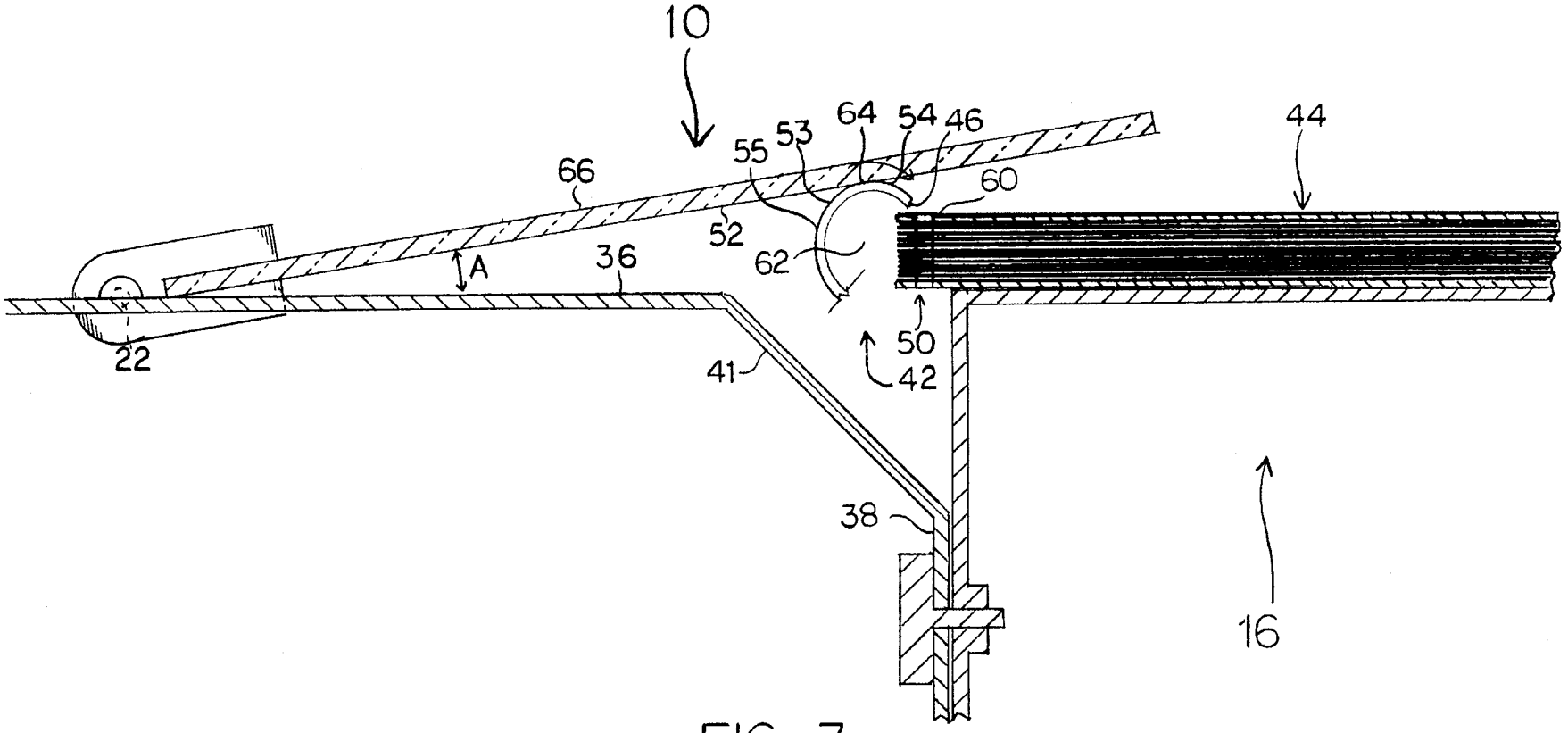
FIG. 3 is a side sectional schematic of the embodiment of FIG. 1, shown with the coil end being deflected down into the notebook hole.

Referring to FIGS. 1–3, there is shown the preferred, but not the only, embodiment of the invented coil insertion guide. The preferred coil insertion guide 10 includes a plate 12 of clear plastic that is pivotally connected to a front table 14 on a coil inserter machine 16. The connection means includes two bosses 18, 18', which are U-shaped brackets that receive the pivot edge of the plate 12 and pivotally connect the plate 12 to a shaft 20. The shaft 20 is a flattened bar, which is attached at its flat side 22 to the front table 14 by screws and has first and second ends 26, 26', which overhang the side edges 28 of the front table 14 to receive the bosses 18, 18' and allow room for the bosses 18, 18' to pivot on the shaft 20. The plate 12 is preferably secured into the bosses 18, 18' by set screws 30.

The plate 12 is preferably made of about ⅛ inch thick (about 115–120/1000 inch) Lexan™ and is generally a rectangle of about 13 inches by 4 inches. One corner 31 of the rectangular shape is preferably, but not necessarily, cut off at about 45° to allow extra room for the operator of the coil inserter 16, when the plate 12 is swung away from the coil 32, to cut and restart the coil 32 into the first paper hole 34.

The front table 14 has a generally horizontal table surface 36, to which the plate 12 is connected, and a generally vertical bracket surface 38 for attachment to the front side 40 of the coil inserter 16. Joining the horizontal table surface 36 and the vertical bracket surface 38 is a slanted corner 41 at about 25°–35° from vertical. The slanted corner 41 provides a space 42 between the coil inserter 16 and the front table 14 in which the coil 32 lies as it rotates into the paper holes 43. The vertical bracket surface 38 has holes and/or slots for receiving screws or other fasteners to attach it to the coil inserter 16. Preferably, these holes, slots, or other attachment means are sized and positioned to make the front table 14 universally attachable to the various designs of coil inserters 16 made by various companies. The front table 14 may be the work table that is frequently included as an accessory on coil inserters 16.

The method of using the coil insertion guide 10 involves swinging the plate 12 over the coil 32, after the punched paper 44 is positioned on the coil inserter 16 and the coil end 46 is started into the first hole 34 of the paper 50 edge or "spine". The plate 12 preferably pivots freely, so that once it is swung over the coil 32, the guide surface 52 of the plate 12 rests weight on the coil 32, preferably touching the outer surface 53 of the coil 32 slightly below the top 54 of the coil's rotation on the side 55 away from the paper holes 43. Preferably, but not necessarily, the plate 12 rests on the coil in a slanted position at an angle (A) about 15°–20° above horizontal. When the coil inserter 16 is started, the coil 32 rotates around its longitudinal centerline 56 underneath the guide surface 52 and spirals into the paper holes 43. The plate 12 is preferably left in place over the coil 32 until the coil end 46 has spiraled into the last hole 58, at which time the coil inserter 16 is turned off, the plate 12 is lifted away from the coil 32, the coil 32 is cut, and the process is started again.

The coil insertion guide 10 acts to greatly improve the spiraling of the coil end 46 into the paper holes 43, preventing the problem of frequent sticking and stopping of the coil end 46 against the paper 44, which has been described in the "Related Art" section above. The coil insertion guide 10 keeps the coil 32 spiraling smoothly and the coil end 46 consistently entering the holes without hanging-up, to make the binding task quicker, smoother, easier, and less demanding on operator attention and skill.

The coil insertion guide 10 is believed to work by applying an sufficient amount of pressure on the rotating coil 32 to keep the coil end 46 consistently pointed in the correct path to smoothly and accurately "thread" each hole 43 rather than hanging up on the paper 60 surrounding the hole 43. It is believed that, as the coil end 46 rotates up and hits the guide surface 52 of the plate 12, it is deflected by the plate 12 slightly downward, or slightly inward toward the center 62 of the coil, relative to its normal path, so that it is more likely to accurately enter and travel through the hole. It is also believed that, the guide surface 52 provides a generally constant and limiting surface to control and stabilize the location of the rotating coil, keeping the coil end rotating in a path with approximately a constant radius and position relative to the paper holes, thus preventing slight wobbling of the coil from throwing the coil end out of its proper path.

The preferred coil insertion guide 10 described above has worked excellently with a Performance Design CI3000 coil inserter 16 using coils 32 with diameters in the range of about ½–2 inches. The coil insertion guide 10 is expected to work excellently for binding of a wide variety of papers, cards, etc., with coils of a wide variety of sizes and materials, for example, plastic or metal coils. The coil inserter guide may be scaled-up or down to fit a variety of machines and applications.

In the preferred embodiment, the plate 12 may contact the coil 32 at a variety of angles, and the performance of the coil insertion guide is not greatly sensitive to this angle. The plate 12 has worked well when resting at angles in the range of about 10°–50° above horizontal. Placing the plate 12 horizontally on the top 54 of the coil 12 has not worked as well as placing the plate 12 at an angle (A) touching the coil 32 at a contact point 64 that is slightly below the top 54 and at the side 55 away from the holes 43.

Because it is believed that the coil insertion guide works, at least in part, by pressing the coil so that the coil end is deflected slightly inward toward the center of the coil as it approaches the hole, it is believed that the plate member should apply force to the coil within the 180° before, or within one-half rotation before, the point in the rotation at which the coil end enters the paper hole. In other words, pressing on the coil at a point in its rotation just after its leaving the hole, or within about 180° after its leaving the hole, would likely push the coil end out from the center as it approaches the hole and cause it to hang-up on the paper.

The plate 12 may be made of various materials, with a transparent material being preferred, so that the operator can see the progress of the coil and see when the coil end has reached the last hole 58. Plexi-glass™ has worked well, but Lexan™ is preferred because of its break- and crack-resistance.

The pressure exerted on the coil 32 by the plate 12 is an important design parameter for making the coil insertion guide work optimally. In the preferred embodiment, because the plate 12 pivots freely and rests on the coil 32, the weight of the plate 12 resting on the coil 32 is believed to be a major factor in determining the pressure or force exerted on the coil. When a ¼ inch thick plate was substituted for the preferred ⅛ inch thick plate 12, the coil insertion guide performance was inferior to that of the preferred embodiment.

Alternatively, the coil insertion guide may be built with a plate member of a design other than the planar plate 12, as long as the plate member contacts the rotating coil near the coil end to guide the coil end into the holes. The plate member need not necessarily be planar on both sides, but may include embodiments, for example, that have a non-planar top surface 66 or even a guide surface 52 than is contoured or curved to match a particular coil application. The plate member need not be rectangular or of the dimensions reported above, however, when varying the shape and design of the plate member, care should be given to ensure that the design will result in the proper weight or pressure being placed on the coil.

Alternatively, the coil insertion guide may include connection means of designs other than the shaft and boss system to connect it to the coil inserter 16, including connection means that connect the plate member to a part of the inserter 16 other than the front table 14 and other than the front side of the inserter 16. For example, the plate member could be attached to a moveable arm that attaches to the back side of the inserter, a desk, or a wall and that can be maneuvered to place the plate in the proper position on the coil. The effect that the connection means has on the pressure placed on the coil should be considered when designing the connection means.

Alternatively, the coil insertion guide need not include a connection means to attach or connect the plate member to the coil inserter 16 or to any other object. I have found that the coil insertion guide may be as simple as a plate member similar to plate 12 being laid on the coil at an angle, without being attached or held down. However, the preferred embodiment of the coil insertion guide includes a connection means, in order to keep the plate member in a reachable position, to make the placement of the plate member easier, and to make the pressure of the plate member on the coil more consistent from use to use.

Alternatively, the coil insertion guide may be designed for use with coil inserter machines that hold the paper or the coil in other than a horizontal position. In such embodiments, the pressure of the plate member on the coil may be created by other than the weight of the plate member and gravity, for example, by a force created by a spring system or a piston system.

Although this invention has been described above with reference to particular means, materials and embodiments, it is to be understood that the invention is not limited to these disclosed particulars, but extends instead to all equivalents within the scope of the following claims.

I claim:

1. An apparatus for facilitating the insertion of an end of a rotating coil into holes punched along an edge of paper to bind the paper into a spiral-bound book, the coil having a longitudinal centerline, and the apparatus comprising:

a coil inserter machine for receiving the paper and the coil and for rotating the coil to insert the coil end into the holes, and a coil insertion guide comprising a plate member having a guide surface substantially parallel to the longitudinal centerline of the coil and contacting an outer surface of the coil as the coil rotates, for guiding the coil end to enter into the said holes, and a connection means for pivotally connection the plate member to the coil inserter machine.

2. An apparatus as set forth in claim 1, wherein the guide surface contacts the outer surface of the coil within one-half rotation of the coil end entering the said holes.

3. As apparatus as set forth in claim 1, wherein the guide surface extends across substantially the entire edge of the paper in which the said holes are punched.

4. An apparatus for facilitating the insertion of an end of a rotating coil into holes punched along an edge of paper to bind the paper into a spiral-bound book, the coil having a longitudinal centerline, and the apparatus comprising:

a coil inserter machine for receiving the paper and the coil and for rotating the coil to insert the coil end into the holes, and a coil insertion guide comprising a plate member having a guide surface substantially parallel to the longitudinal centerline of the coil and contacting an outer surface of the coil as the coil rotates, for guiding the coil end to enter into the said holes, and a connection means for pivotally connecting the plate member to the coil inserter machine, and wherein the paper received by the coil inserter machine is substantially horizontal and the plate member guide surface rests on the outer surface of the coil at an angle of 10°–50° above horizontal.

5. A coil insertion guide for use with a coil inserter machine for facilitating the insertion of an end of a rotating coil into holes punched along the edge of paper to bind the paper into a spiral-bound book, the paper being held horizontally by the coil inserter machine and the coil having a longitudinal centerline, the coil insertion guide comprising:

a plate member having a guide surface substantially parallel to the longitudinal centerline of the coil and contacting an outer surface of the coil as the coil rotates, for guiding the coil end to enter into the holes, a substantially horizontal table surface connected to and extending out from the coil inserter machine, and a connection means pivotally connecting the plate member to the table surface, so that the plate member can be swung over the coil to rest the guide surface on the outer surface of the coil and so that the plate member can be swung away from the coil when not in use.

6. An apparatus as set forth in claim 5, wherein the guide surface contacts the outer surface of the coil within one-half rotation of the coil end entering the said holes.

7. As apparatus as set forth in claim 5, wherein the guide surface extends across substantially the entire edge of the paper in which the said holes are punched.

8. An apparatus as set forth in claim 5, wherein the plate member guide surface rests on the outer surface of the coil at an angle of 10°–50° above horizontal.

9. An apparatus as set forth in claim 5, wherein the plate member is a plate of Lexan™ about ⅛ inch thick.

10. An apparatus as set forth in claim 5, wherein the plate member is a plate of Plexi-glass™ about ⅛ inch thick.

* * * * *